US009057981B2

(12) United States Patent
Hashimoto et al.

(10) Patent No.: US 9,057,981 B2
(45) Date of Patent: Jun. 16, 2015

(54) DEVELOPER CONTAINER AND DEVELOPING DEVICE

(71) Applicants: Junichi Hashimoto, Toyohashi (JP); Shuichi Kato, Nagoya (JP)

(72) Inventors: Junichi Hashimoto, Toyohashi (JP); Shuichi Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/010,990

(22) Filed: Aug. 27, 2013

(65) Prior Publication Data

US 2014/0056620 A1 Feb. 27, 2014

(30) Foreign Application Priority Data

Aug. 27, 2012 (JP) ..... 2012-186166

(51) Int. Cl.
*G03G 15/08* (2006.01)
*G03G 21/16* (2006.01)

(52) U.S. Cl.
CPC ..... *G03G 15/0839* (2013.01); *G03G 21/1676* (2013.01); *G03G 15/0889* (2013.01); *G03G 15/0865* (2013.01); *G03G 15/0877* (2013.01); *G03G 15/0896* (2013.01)

(58) Field of Classification Search
CPC ..... G03G 15/0822
USPC ..... 399/252, 254–256
See application file for complete search history.

(56) References Cited

U.S. PATENT DOCUMENTS

| | | | | |
|---|---|---|---|---|
| 5,884,130 | A * | 3/1999 | Tsutsumi et al. | 399/254 |
| 7,224,925 | B2 * | 5/2007 | Sato et al. | 399/263 |
| 7,860,437 | B2 | 12/2010 | Kakuta et al. | |
| 2008/0247784 | A1 | 10/2008 | Kakuta et al. | |
| 2011/0076062 | A1 | 3/2011 | Kakuta et al. | |
| 2012/0170955 | A1 | 7/2012 | Kakuta et al. | |
| 2013/0011163 | A1 * | 1/2013 | Senda et al. | 399/254 |
| 2014/0056621 | A1 * | 2/2014 | Hashimoto et al. | 399/254 |

FOREIGN PATENT DOCUMENTS

JP 2008-170951 A 7/2008

* cited by examiner

*Primary Examiner* — Rodney Bonnette
(74) *Attorney, Agent, or Firm* — Banner & Witcoff, Ltd.

(57) ABSTRACT

A developer container includes: a container body that has an opening at an upper part and is configured to accommodate therein developer; a conveyance member that is provided in the container body, and includes a rotation member having a rotary shaft and an elastic part, which is supported by the rotation member, is configured to be elastically deformed and is configured to rotate to convey the developer from the opening to an outside of the container body; and a driving member that is connected to one end portion of the rotary shaft and is configured to rotate the rotary shaft. The container body includes a first support part to which the other end portion of the rotary shaft is loosely fitted and a second support part that supports the one end portion of the rotary shaft.

9 Claims, 10 Drawing Sheets

DEVELOPER CONTAINER AND DEVELOPING DEVICE

CROSS-REFERENCE TO RELATED APPLICATION

This application is based upon and claims the benefit of priority of Japanese Patent Application No. 2012-186166 filed on Aug. 27, 2012, the contents of which are incorporated herein by reference in its entirety.

BACKGROUND

The disclosure relates to a developer container having a conveyance member that is rotated to thus convey developer in a container body to an outside of the container body, and a developing device.

A developer container has been known in which a developer accommodation unit (a container body) accommodating therein developer is arranged below a developing unit and the developer in the developer accommodation unit is conveyed to the developing unit through an opening formed at an upper part of the developer accommodation unit (for example, refer to JP-A-2008-170951).

In the developer container, the developer accommodation unit is provided with a toner conveyance member (a conveyance member). The toner conveyance member is rotated with being bent while sliding-contacting an inner wall of the developer accommodation unit, thereby picking up the developer in the developer accommodation unit. When the toner conveyance member is spaced from the inner wall, it jumps out to thus scatter the picked up developer, thereby conveying the same from the opening towards the developing unit.

SUMMARY

According to the above technology, in order to stabilize a force for scattering the developer, it is important to position a rotating center in precision when the toner conveyance member (the conveyance member) is spaced from the inner wall of the developer accommodation unit (the container body). Thus, it is considered to fit a rotary shaft of the toner accommodation member to a support part that is provided to the developer accommodation unit. However, in this case, when the developer is introduced into a gap between the rotary shaft and the support part, the developer may be agglomerated.

Therefore, an object of the disclosure is to provide a developer container and a developing device capable of reducing a phenomenon that developer is introduced and agglomerated in a gap between a rotary shaft of a conveyance member and a support part supporting the rotary shaft and effectively conveying the developer.

A developer container comprising:

a conveyance member including a rotation member having a rotary shaft extending in a first direction, and an elastic part which is supported by the rotation member and is configured to be elastically deformed;

a driving member that is connected to one end portion of the rotary shaft and is configured to rotate the rotary shaft; and a container body configured to accommodate therein developer, the container body including:

a first side wall including a first support part configured to support the other end portion of the rotary shaft, the first support part including a first surface and a second surface extending in a direction intersecting with the first surface;

a second side wall disposed apart from the first side wall in the first direction, the second side wall including a second support part configured to support the one end portion of the rotary shaft; and a peripheral wall disposed between the first and second side walls, the peripheral wall including a sliding contact part that is provided in the vicinity of an upstream side in a rotating direction of the conveyance member as regards an opening communicating an inside of the container body with an outside of the container;

wherein the first surface and the second surface are arranged so that the rotary shaft abuts on both the first surface and the second surface at a moment that the elastic part being rotated is separated from the sliding contact part.

A developing device comprising:

a developing unit that is provided with a developing roller;

a conveyance member including a rotation member having a rotary shaft extending in a first direction, and an elastic part which is supported by the rotation member and is configured to be elastically deformed; and a developer accommodation unit configured to accommodate therein developer, the developer accommodation unit including:

a first side wall including a first support part configured to support the other end portion of the rotary shaft, the first support part including a first surface and a second surface extending in a direction intersecting with the first surface;

a second side wall disposed apart from the first side wall in the first direction, the second side wall including a second support part configured to support the one end portion of the rotary shaft; and a peripheral wall disposed between the first and second side walls, the peripheral wall including a sliding contact part that is provided in the vicinity of an upstream side in a rotating direction of the conveyance member as regards an opening through which the developer accommodation communicates with the developing unit;

wherein the first surface and the second surface are arranged so that the rotary shaft abuts on both the first surface and the second surface at a moment that the elastic part being rotated is separated from the sliding contact part.

A developer container comprising:

a container body that has an opening and is configured to accommodate therein developer; and a conveyance member that is provided in the container body, and includes:

a rotation member having a rotary shaft; and an elastic part, which is supported by the rotation member, is configured to be elastically deformed and is configured to rotate to convey the developer from the opening to an outside of the container body;

wherein the container body includes a recess part which includes at least three surfaces which are arranged to form a polygonal shape in a cross section, wherein the rotary shaft is loosely fitted into the recess part so that any one of the three surfaces is always separated from the rotary shaft.

DESCRIPTION OF EXEMPLARY EMBODIMENTS

Hereinafter, an exemplary embodiment will be specifically described with reference to the drawings. Meanwhile, in the below descriptions, a schematic configuration of a color printer 1 having a developing cartridge 100, which is an example of the developing device (developer container) according to this exemplary embodiment, will be first described.

Also, in the below descriptions, a direction is described based on a user who uses the color printer 1. That is, the left side in FIG. 1 is referred to as the 'front', the right side is referred to as the 'rear', the front side is referred to as the 'right' and the inner side is referred to as the 'left.' Also, the upper and lower directions in FIG. 1 are referred to as the 'upper-lower.'

<Schematic Configuration of Color Printer>

Figure 1:
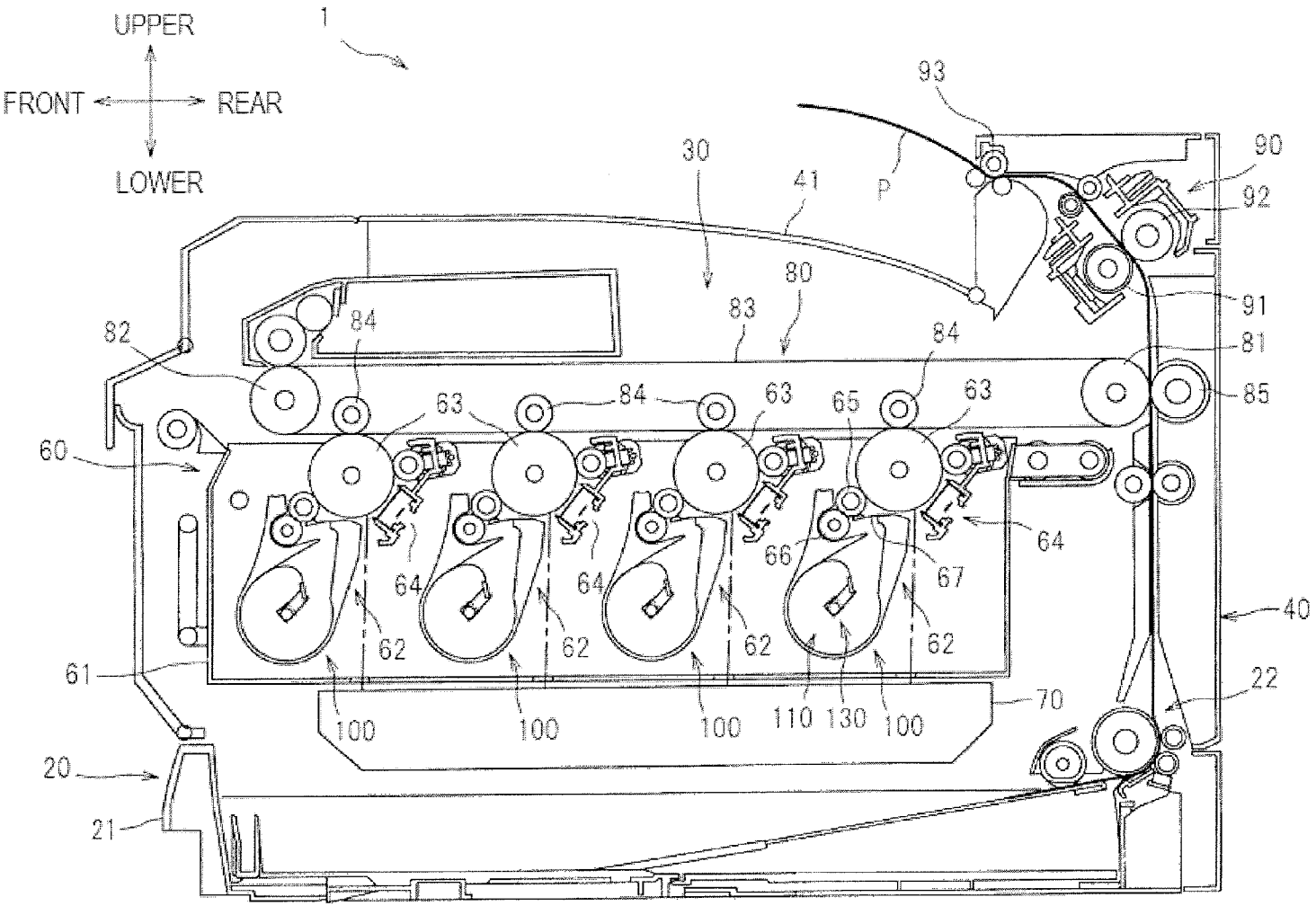
FIG. 1 shows a schematic configuration of a color printer having a developing cartridge according to an exemplary embodiment.

As shown in FIG. 1, the color printer 1 mainly has, in a body housing 40, a feeder unit 20 that feeds sheets P and an image forming unit 4 that forms an image on the fed sheet P.

The feeder unit 20 is provided at the lower in the body housing 40 and mainly has a sheet feeding tray 21 that accommodates therein the sheets P and a sheet feeding mechanism 22 that conveys the sheet P from the sheet feeding tray 21 to the image forming unit 30. The sheets P in the sheet feeding tray 21 are separated one by one and conveyed to the image forming unit 30 by the sheet feeding mechanism 22.

The image forming unit 30 mainly has an exposure unit 70, a process unit 60, a transfer unit 80 and a fixing unit 90.

The exposure unit 70 is provided above the feeder unit 20 and has a laser light source, a polygon mirror, a lens, a reflecting mirror and the like, which are not shown. A laser light emitted from the laser light source is reflected on the polygon mirror or reflecting mirror, passes through the lens and is scanned on surfaces of respective photosensitive drums 63 at high speed.

The process unit 60 is arranged above the exposure unit 70 and mainly has four process cartridges 62 that are arranged in a front-rear direction and a holding case 61 that holds the process cartridges 62.

The process cartridge 62 mainly has the photosensitive drum 63, a charger 64 and a developing cartridge 100.

The developing cartridge 100 has a developing roller 65, a supply roller 66, a layer thickness regulation blade 67 and a toner conveyance member 130 that is an example of the conveyance member, and accommodates toner T (developer) in a toner accommodation unit 110 (the developer accommodation unit) that is an example of the container body.

Figure 2A:
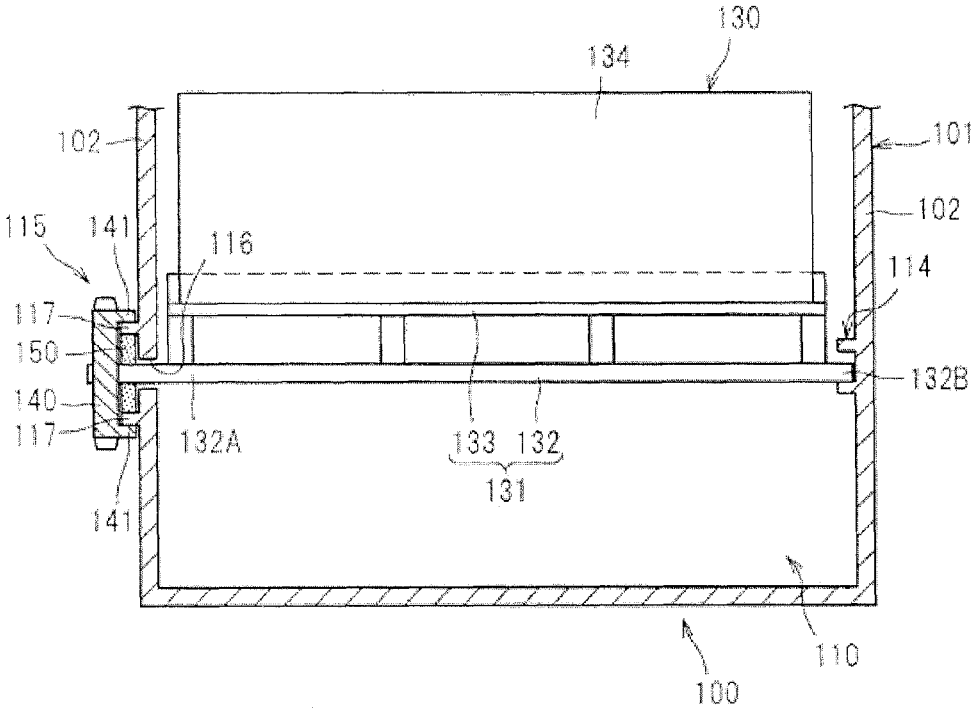
FIG. 2A is a sectional view of the developing cartridge showing a first support part and a second support part and FIG. 2B is a sectional view showing a positional relation of the first support part and the second support part in an axis line direction.

As shown in FIG. 2A, the toner conveyance member 130 has a rotation member 131 and a sheet member 134 that is an example of the elastic part.

The rotation member 131 has a shaft part 132 that is an example of the rotary shaft and a sheet attachment part 133.

The shaft part 132 is a shaft extending along an axis direction of the developing roller 65 or supply roller 66 and is rotatably supported to the toner accommodation unit 110. The sheet attachment part 133 extends outwards from the shaft part 132 in a diametrical direction and has a leading end portion to which the sheet member 134 is fixed.

The sheet member 134 is a member that is made of PET (polyethylene terephthalate) resin, for example, and can be elastically deformed. The sheet member 134 has a base end portion that is supported to the sheet attachment part 133 of the rotation member 131 by adhesion and the like.

The toner conveyance member 130 configured as described above is rotated about the shaft part 132 in a clockwise direction to thus pick up the toner T in the toner accommodation unit 110, thereby conveying the same towards a developing unit 120 (refer to FIG. 2B) accommodating therein the developing roller 65 and the like, which will be described later.

In the meantime, the configuration of the developing cartridge 100 will be specifically described later.

Back to FIG. 1, the transfer unit 80 is provided above the process units 60 and mainly has a driving roller 81, a driven roller 82, an endless intermediate transfer belt 83 that is provided in a tensioned state between the driving roller 81 and the driven roller 82 and is arranged to face the respective photosensitive drums 63, four primary transfer rollers 84 that are arranged to sandwich the intermediate transfer belt 83 between the primary transfer rollers and the photosensitive drums 63 and a secondary transfer roller 85 that is arranged to face the driving roller 81 with the intermediate transfer belt 83 being interposed therebetween.

The fixing unit 90 is provided at the rear-upper of the transfer unit 80 and mainly has a heating roller 91 and a pressing roller 92 that is arranged to face the heating roller 91 and presses the heating roller 91.

In the image forming unit 30, a surface of the photosensitive drum 63 is uniformly charged by the charger 64 and is then exposed by high-speed scanning of the laser light emitted from the exposure unit 70, so that an electrostatic latent image based on image data is formed on the photosensitive drum 63. Also, the toner T in the developing cartridge 100 is supplied to the developing roller 65 through the supply roller 66, is introduced between the developing roller 65 and the layer thickness regulation blade 67 and is carried on the developing roller 65 as a thin layer having a predetermined thickness.

The toner T carried on the developing roller 65 is supplied from the developing roller 65 to the electrostatic latent image on the photosensitive drum 63. Thereby, the electrostatic latent image becomes visible, so that a toner image (an image) is formed on the photosensitive drum 63.

The toner images of respective colors formed on the respective photosensitive drums 63 are sequentially transferred with being overlapped onto the intermediate transfer belt 83. Then, the sheet P conveyed from the feeder unit 20 is conveyed through between the intermediate transfer belt 83 and the secondary transfer roller 85, so that the toner images on the intermediate transfer roller 83 is transferred to the sheet P. The sheet P having the toner images transferred thereto is conveyed through between the heating roll 91 and the pressing roller 92, so that the toner images are heat-fixed. Then, the sheet is discharged onto a sheet discharge tray 41, which is provided at the upper part of the body housing 40, by sheet discharge rollers 93.

<Detailed Configuration of Developing Cartridge>

Subsequently, a detailed configuration of the developing cartridge 100 is described.

Figure 2B:
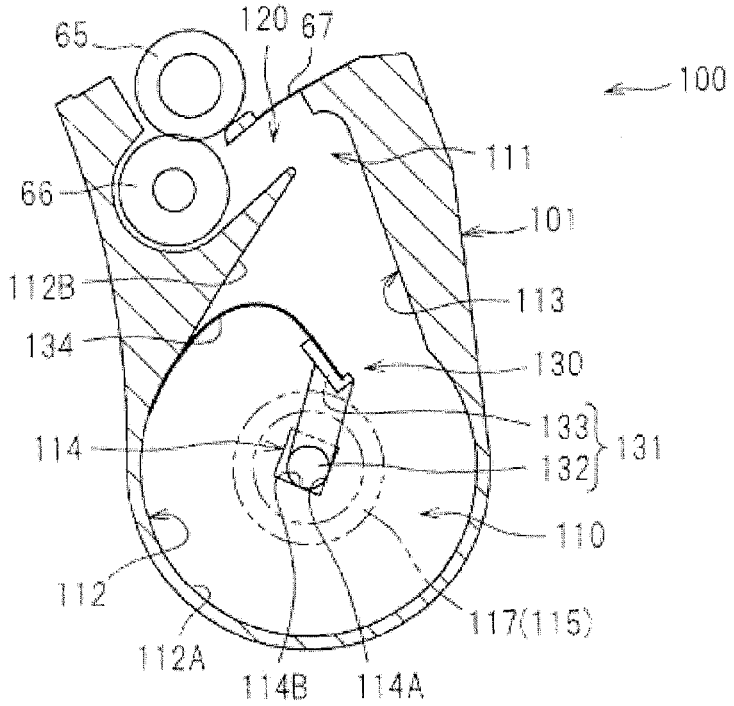

As shown in FIG. 2B, the developing cartridge 100 has a housing 101 having a toner accommodation unit 110 that accommodates therein the toner T and a developing unit 120 that is arranged above the toner accommodation unit 110.

Also, the developing cartridge 100 mainly has the toner conveyance member 130 that is arranged in the toner accommodation unit 110, the developing roller 65, the supply roller 66 and the layer thickness regulation blade 67, which are arranged in the developing unit 120, and a gear 140 (refer to FIG. 2A) that is an example of the driving member fixed to one end portion 132A of the shaft part 132 of the toner conveyance member 130.

The toner accommodation unit 110 has a communication hole 111 that is an example of the opening formed at the upper thereof, and an inner space thereof communicates with an inner space of the developing unit 120, which is provided above an inclined surface 112B (which will be described later), through the communication hole 111.

Also, the toner accommodation unit 110 has a substantial raindrop shape having a sliding contact part 112 and a collision part 113, when seen from a section.

The sliding contact part 112 is an inner surface of the toner accommodation part 110 that is provided in the vicinity of an upstream side in a rotating direction of the toner conveyance member 130 (hereinafter, simply referred to as 'rotating direction') as regards the communication hole 111. The sliding contact part 112 has an arc surface 112A and the inclined surface 112B.

The arc surface 112A configures an inner surface of a substantial lower half of the toner accommodation unit 110 and has a substantially arc shape having an open upper part. In the meantime, a radius of the arc surface 112A is smaller than a length from a center of the shaft part 132 of the toner accommodation member 130 to a leading end of the sheet member 134 that is at a not-deformed state.

The inclined surface 112B is a surface that continuously extends from a downstream end portion of the arc surface 112A in the rotating direction to an edge of the communication hole 111, and is formed so that a distance from an arc center of the arc surface 112A is increased as the inclined surface comes closer to the communication hole 111.

The collision part 113 is an inner surface of the toner accommodation part 110 that is provided in the vicinity of a downstream side in the rotating direction as regards the communication hole 111. The collision part 113 extends from the communication hole 111 to an upstream end portion of the arc surface 112A in the rotating direction.

Also, as shown in FIG. 2A, the toner accommodation unit 110 has a first support part 114 and a second support part 115 for supporting the shaft part 132 of the toner conveyance member 130 at both left and right sidewalls 102.

The first support part 114 is a recess part that is formed on an inner surface of the sidewall 102 and is larger than a diameter of the shaft part 132, so that the other end portion 132B of the shaft part 132 is loosely fitted therein. As shown in FIG. 2B, the first support part 114 has a substantial square shape, when seen from the side, and has a first surface 114A and a second surface 114B, which configure an inner periphery of the first support part 114. The first surface 114A is arranged at an opposite side to the inclined surface 112B as regards the shaft part 132. The second surface 114B extends in a direction intersecting with the first surface 114A and is arranged below the shaft part 132.

The first surface 114A and the second surface 114B are arranged at positions and in directions at which the other end portion 132B of the shaft part 132 abuts on both the first surface 114A and the second surface 114B after the sheet member 134 being rotated starts to sliding-contact the inclines surface 112B until it is then separated therefrom.

Also, the first surface 114A and the second surface 114B are provided at positions at which a rotating center of the other end portion 132B of the shaft part 132 is coaxially arranged with the second support part 115 (which will be described later) (specifically, a gear support part 117) when the other end portion 132B of the shaft part 132 abuts on both the first surface 114A and the second surface 114B.

As shown in FIG. 2A, the second support part 115 axially supports the rotation of the one end portion 132A of the shaft part 132. The second support part 115 has a hole 116, which is formed at a position of the sidewall 102 facing the first support part 114, and a gear support part 117.

The hole 116 is larger than the one end portion 132A of the shaft part 132.

The gear support part 117 protrudes from the sidewall 102 to the outside of the housing 101 and has an arc shape that is coaxial with the arc center of the arc surface 112A. Here, the gear 140 has an arc part 141, which protrudes towards the sidewall 102, on a surface thereof facing the sidewall 102. An inner diameter of the arc part 141 is set to be substantially the same as an outer diameter of the gear support part 117. The gear 140 is fitted to the gear support part 117 so that a rotary shaft thereof does not shake. In the meantime, the gear 140 is input with a driving force from a driving source (not shown) that is provided in the body housing 40.

A seal member 150 is in close contact with an inner side of the gear support part 117 so that the toner is not leaked from between the gear support part 117 and the shaft part 132.

In the below, operations of the developing cartridge 100 configured as described above are described.

Figure 3:
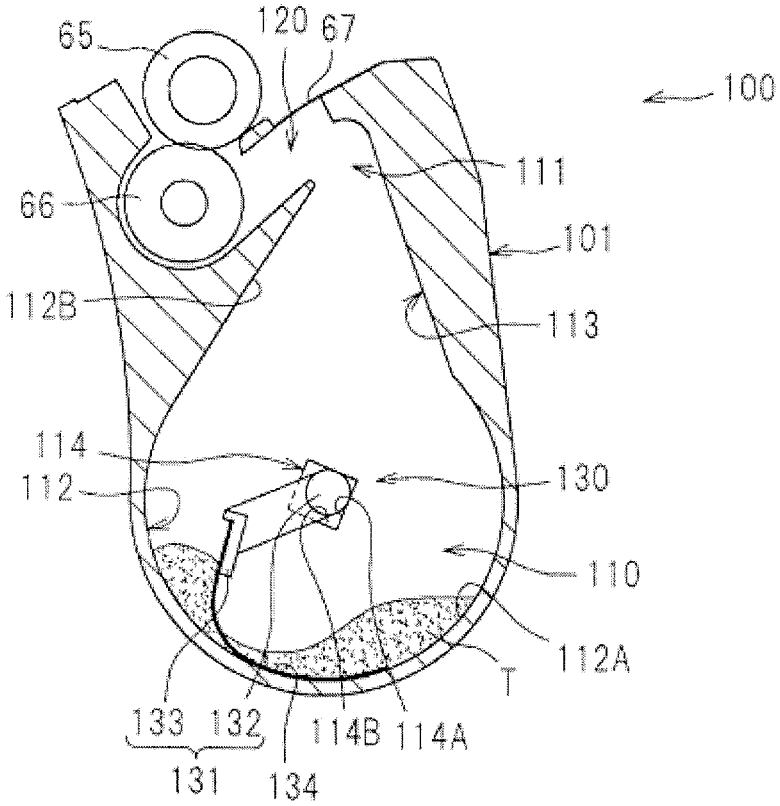
FIG. 3 shows a state where a sheet member sliding-contacts an arc surface.

When the driving force is input to the gear 140 and the toner conveyance member 130 is thus rotated, the sheet member 134 is rotated while it sliding-contacts the sliding contact part 112 with being elastically deformed and picks up the toner T in the toner accommodation unit 110, as shown in FIG. 3.

When the sheet member 134 sliding contacts the lower part of the arc surface 112A, the shaft part 132 is moved upwards in the first support part 114 by a reaction force applied to the rotation member 131 and is thus lifted from the second surface 114B.

Figure 4:
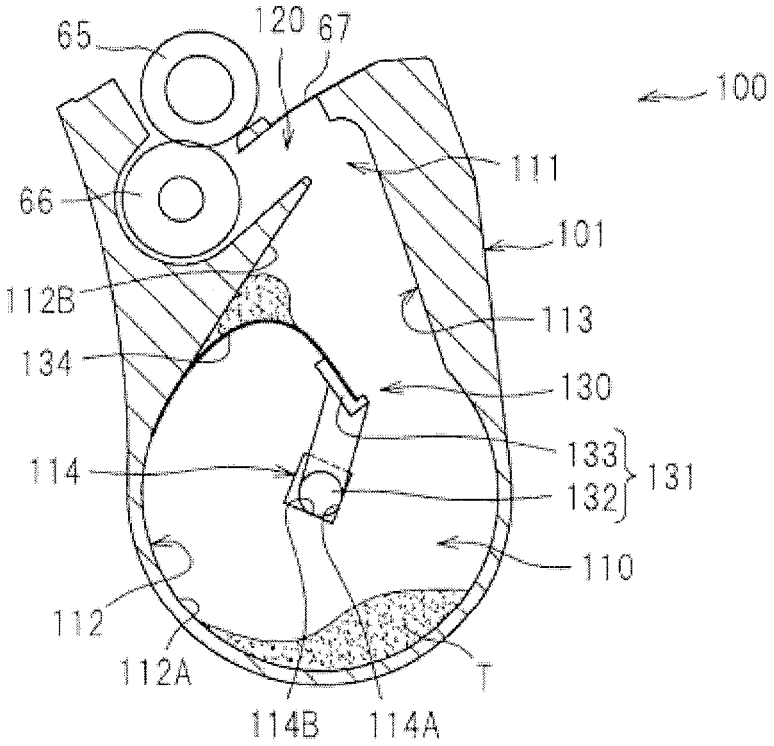
FIG. 4 shows a state where the sheet member starts to sliding-contact an inclined surface.

As shown in FIG. 4, when the sheet member 134 starts to sliding-contact the inclined surface 112B, a force that is directed in a direction separating from the inclined surface 112B is applied to the shaft part 132 by the reaction force applied to the rotation member 131. That is, the shaft part 132 is pressed in right and downward directions of FIG. 4. At this time, the shaft part 132 abuts on both the first surface 114A and the second surface 114B.

Figure 5:
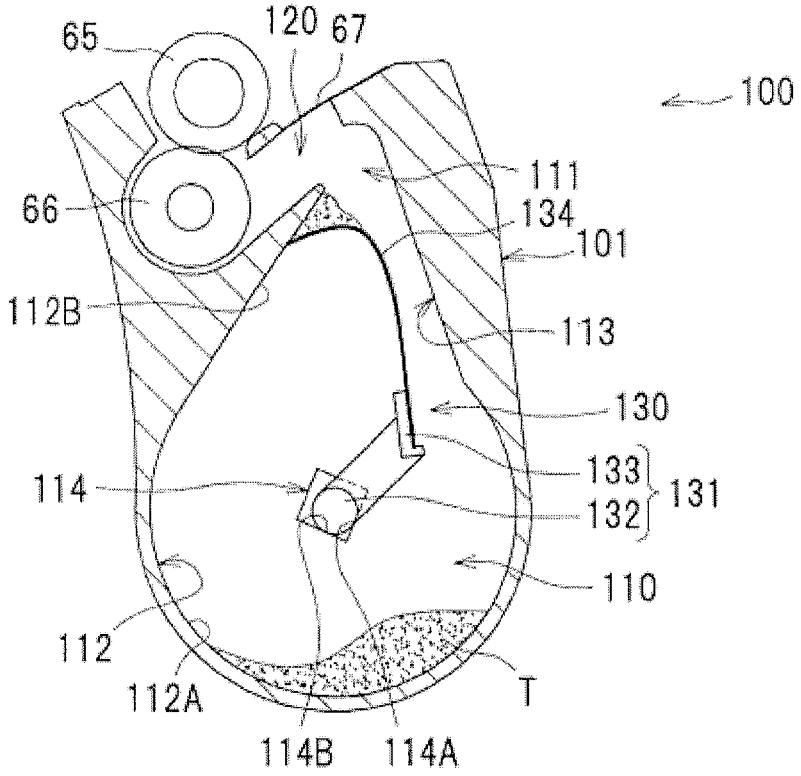
FIG. 5 shows a state just before the sheet member is separated from the inclined surface.

As shown in FIG. 5, the shaft part 132 keeps abutting on both the first surface 114A and the second surface 114B until the sheet member 134 is separated from the inclined surface 112B.

Then, when the sheet member 134 is separated from the inclined surface 112B, the leading end of the sheet member 134 jumps out by the elastic force of the sheet member 134 and thus collides with the collision part 113. Thereby, the toner T put on the sheet member 134 is scattered towards the communication hole 111 by an air stream generated by the sheet member 134 and is then supplied to the developing unit 120 (the outside of the toner accommodation unit 110).

Figure 6:
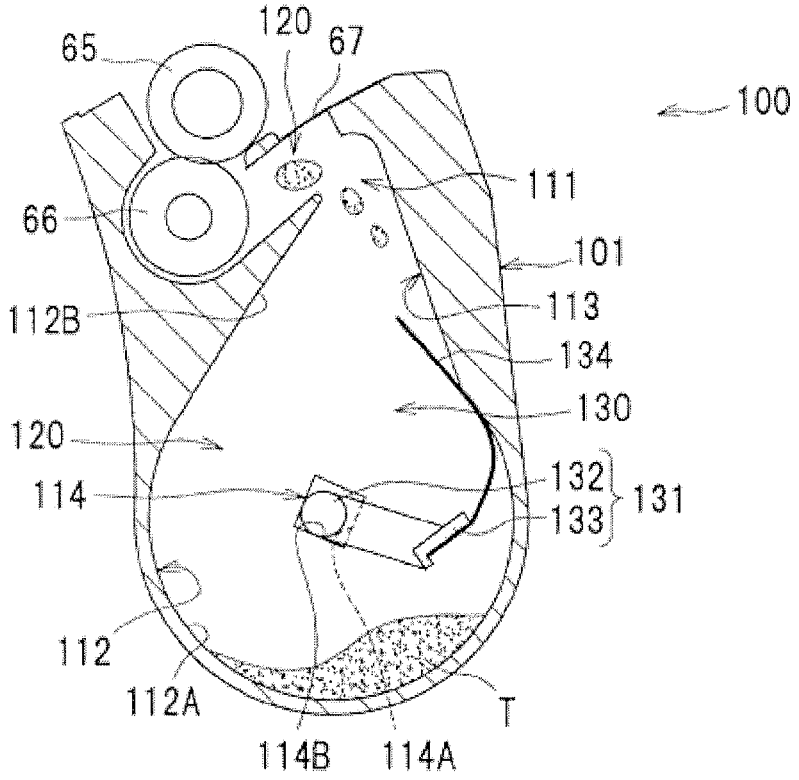
FIG. 6 shows a state where the sheet member is separated from the inclined surface and then again starts to sliding-contact the arc surface.

As shown in FIG. 6, after the collision with the collision part 113, the sheet member 134 again starts to sliding-contact the arc surface 112A with being bent. At this time, the shaft part 132 is moved in the direction separating from the first surface 114A in the first support part 114 by the reaction force applied to the rotation member 131.

As described above, when the toner conveyance member 130 is being rotated, the other end portion 132B of the shaft part 132 to which the gear 140 is not fixed is moved in the first support part 114. Therefore, even when the toner T is introduced into the gap between the shaft part 132 and the first support part 114, the toner is suppressed from being agglomerated in the gap.

Also in the configuration where the other end portion 132B of the shaft part 132 is moved in the first support part 114, after the sheet member 134 being rotated starts to sliding-contact the inclines surface 112B until it is then separated therefrom, i.e., when the sheet member 134 is returned from the bent state to the extension state and thus scatters the toner T, the other end portion 132B of the shaft part 132 is supported from the two directions on the first surface 114A and the second surface 114B, so that it is possible to stabilize a behavior of the toner conveyance member 130 upon the scattering of the toner T. Thereby, it is possible to effectively convey the toner T by the toner conveyance member 130.

When the other end portion 132B of the shaft part 132 abuts on both the first surface 114A and the second surface 114B, the rotating center of the other end portion 132B of the shaft part 132 is coaxially aligned with the second support part 115 (the rotating center of the one end portion 132A of the shaft part 132). Therefore, when the toner T is scattered by the toner conveyance member 130, the force of the toner conveyance member 130 conveying the toner T becomes substantially uniform, irrespective of positions in an axis line direction.

Although the exemplary embodiment has been described, it should be noted that the invention is not limited to the above exemplary embodiment. The specific configuration can be appropriately changed without departing from the gist of the invention.

In the above exemplary embodiment, the first support part 114 has the substantial square shape. However, the invention is not limited thereto. For example, any shape is possible insomuch as the first support part has a first surface and a second surface supporting the shaft part 132 from two directions after the sheet member 134 being rotated starts to sliding-contact the inclined surface 112B until it is then separated therefrom.

Figure 7:
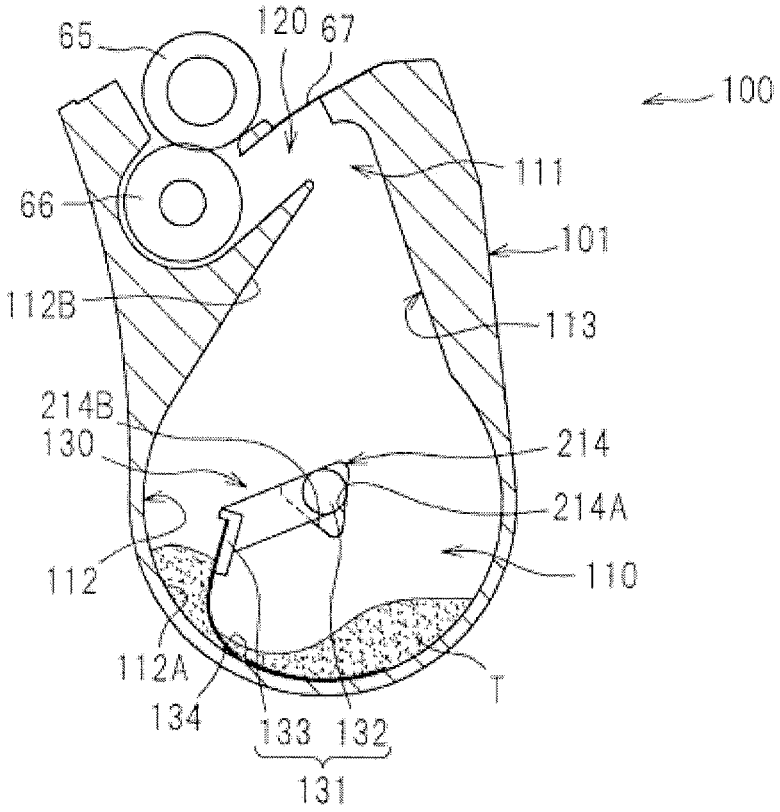
FIG. 7 shows a state where the sheet member sliding-contacts the arc surface in a modified embodiment.

For example, as shown in FIG. 7, a first support part 214 may have a triangular shape. The first support part 214 has a first surface 214A that is arranged at an opposite side to the inclined surface 112B as regards the shaft part 132 and a second surface 214B that extends in a direction intersecting with the first surface 214A and abuts on the shaft part 132 from the lower side thereof. The first surface 214A and the second surface 214B are opened towards the inclined surface 112B and the shaft part 132 is arranged therebetween. Like this, the first support part 214 has the triangular shape, so that it is possible to reduce an angle between the first surface 214A and the second surface 214B, compared to the configuration where the first support part 114 has the substantial square shape. Thereby, it is possible to enable the shaft part 132 to abut on both the first surface 214A and the second surface 214B for a long time.

In the developing cartridge 100 configured as described above, when the sheet member 134 sliding-contacts the lower part of the arc surface 112A, the shaft part 132 is moved upwards in the first support part 24 by the reaction force applied to the rotation member 131 and is thus lifted from the second surface 214B.

Figure 8:
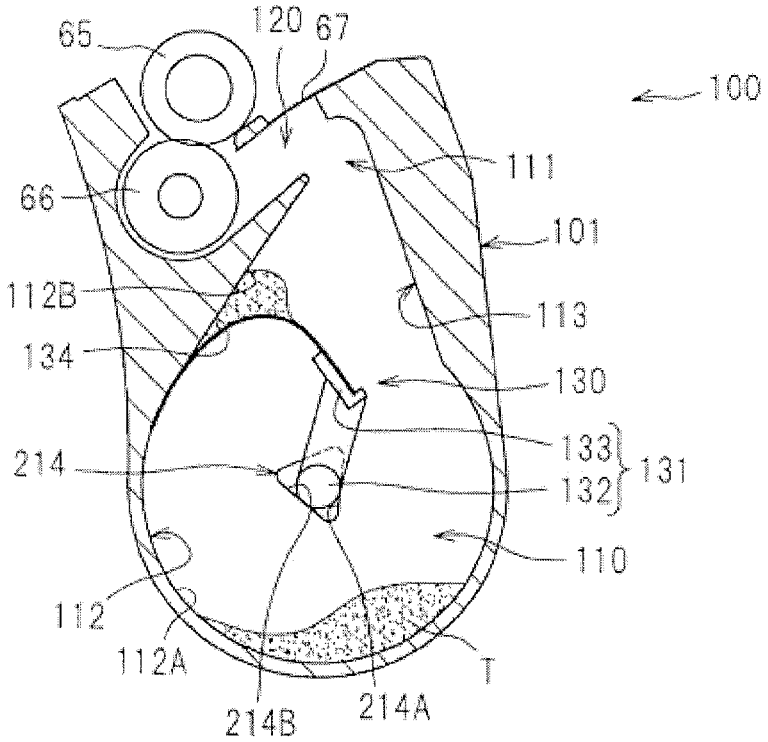
FIG. 8 shows a state where the sheet member starts to sliding-contact the inclined surface in the modified embodiment.

As shown in FIG. 8, when the sheet member 134 starts to sliding-contact the inclined surface 112B, the force that is directed in the direction separating from the inclined surface 112B is applied to the shaft part 132 by the reaction force applied to the rotation member 131. At this time, the shaft part 132 abuts on both the first surface 214A and the second surface 214B.

Figure 9:
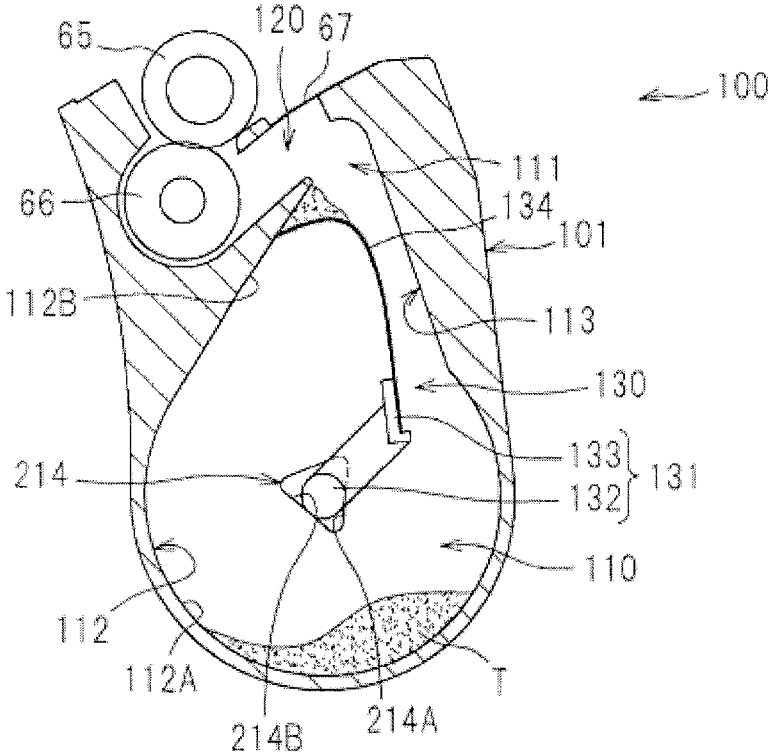
FIG. 9 shows a state just before the sheet member is separated from the inclined surface in the modified embodiment.

As shown in FIG. 9, the shaft part 132 keeps abutting on both the first surface 214A and the second surface 214B until the sheet member 134 is separated from the inclined surface 112B.

Figure 10:
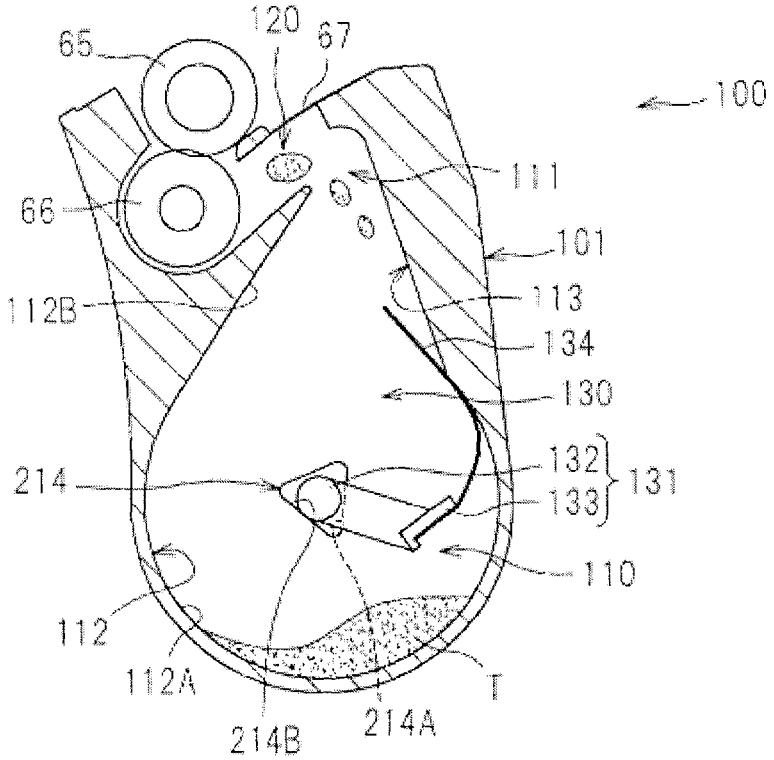
FIG. 10 shows a state where the sheet member is separated from the inclined surface and then again starts to sliding-contact the arc surface in the modified embodiment.

Then, as shown in FIG. 10, when the sheet member 134 separates from the inclined surface 112B and then again starts to sliding-contact the arc surface 112A with being bent, the shaft part 132 is moved in the direction separating from the first surface 214A in the first support part 214 by the reaction force applied to the rotation member 131.

In the above exemplary embodiment, the first surface 114A and the second surface 114B are arranged so that the shaft part 132 abuts on both the first surface 114A and the second surface 114B after the sheet member 134 being rotated starts to sliding-contact the inclined surface 112B until it is separated therefrom. However, the invention is not limited thereto. For example, the first surface and the second surface may be arranged so that the shaft part 132 abuts on both the first surface and the second surface at least at the moment that the sheet member 134 is separated from the inclined surface 112B.

Also in the above configuration, since it is possible to support the shaft part 132 on the first surface and the second surface at the moment that the toner T is scattered by the sheet member 134, it is possible to effectively convey the toner T.

Also, in the above exemplary embodiment, the sheet member 134 made of PET resin has been exemplified as the elastic part. However, the invention is not limited thereto. For example, the elastic part may be a film made of Teflon (registered trademark), urethane, PEEK (polyether ether ketone) resin, polycarbonate resin, nylon and the like, a thin metal plate made of stainless steel, phosphor bronze and the like, a rubber and the like.

What is claimed is:

1. A developer container comprising:

a conveyance member including a rotation member having a rotary shaft extending in a first direction, and an elastic part which is supported by the rotation member and is configured to be elastically deformed;

a driving member that is connected to one end portion of the rotary shaft and is configured to rotate the rotary shaft; and a container body configured to accommodate therein developer, the container body including:

a first side wall including a first support part configured to support another end portion of the rotary shaft, the first support part including a first surface and a second surface extending in a direction intersecting with the first surface;

a second side wall disposed apart from the first side wall in the first direction, the second side wall including a second support part configured to support the one end portion of the rotary shaft; and a peripheral wall disposed between the first and second side walls, the peripheral wall including a sliding contact part that is provided in the vicinity of an upstream side in a rotating direction of the conveyance member as regards an opening communicating an inside of the container body with an outside of the container and that the elastic part sliding-contacts while being elastically deformed when the conveyance member is being rotated, wherein the first surface and the second surface are arranged so that the rotary shaft abuts on both the first surface and the second surface at a moment that the elastic part being rotated is separated from the sliding contact part.

2. The developer container according to claim 1, wherein the sliding contact part includes an arc surface having an arc shape and an inclined surface that continuously extends from a downstream end portion of the arc surface in the rotating direction and is formed so that a distance from an arc center of the arc surface increases as the inclined surface comes closer to the opening, and the first surface and the second surface are arranged so that the rotary shaft abuts on both the first surface and the second surface after the elastic part being rotated starts to sliding-contact the inclined surface until the elastic part separates from the inclined surface.

3. The developer container according to claim 1, wherein a rotating center of the other end portion of the rotary shaft is coaxially arranged with the second support part when the rotary shaft abuts on both the first surface and the second surface.

4. A developing device comprising:

a developing unit that is provided with a developing roller;

a conveyance member including a rotation member having a rotary shaft extending in a first direction, and an elastic part which is supported by the rotation member and is configured to be elastically deformed; and a developer accommodation unit configured to accommodate therein developer, the developer accommodation unit including:

a first side wall including a first support part configured to support another end portion of the rotary shaft, the first support part including a first surface and a second surface extending in a direction intersecting with the first surface;

a second side wall disposed apart from the first side wall in the first direction, the second side wall including a second support part configured to support the one end portion of the rotary shaft; and a peripheral wall disposed between the first and second side walls, the peripheral wall including a sliding contact part that is provided in the vicinity of an upstream side in a rotating direction of the conveyance member as regards an opening through which the developer accommodation communicates with the developing unit and that the elastic part sliding-contacts while being elastically deformed when the conveyance member is being rotated, wherein the first surface and the second surface are arranged so that the rotary shaft abuts on both the first surface and the second surface at a moment that the elastic part being rotated is separated from the sliding contact part.

5. The developing device according to claim 4, wherein the sliding contact part has an arc surface having an arc shape and an inclined surface that continuously extends from a downstream end portion of the arc surface in the rotating direction and is formed so that a distance from a center of the arc surface increases as the inclined surface comes closer to the opening, and the first surface and the second surface are arranged so that the rotary shaft abuts on both the first surface and the second surface after the elastic part being rotated starts to sliding-contact the inclined surface until the elastic part separates from the inclined surface.

6. The developing device according to claim 4, wherein a rotating center of the other end portion of the rotary shaft is coaxially arranged with the second support part when the rotary shaft abuts on both the first surface and the second surface.

7. A developer container comprising:

a container body that has an opening and is configured to accommodate therein developer; and a conveyance member that is provided in the container body, and includes:

a rotation member having a rotary shaft; and an elastic part, which is supported by the rotation member, is configured to be elastically deformed and is configured to rotate to convey the developer from the opening to an outside of the container body, wherein the container body includes a recess part which includes at least three surfaces which are arranged to form a polygonal shape in a cross section, and wherein the rotary shaft is loosely fitted into the recess part so that any one of the three surfaces is always separated from the rotary shaft.

8. The developer container according to claim 7, wherein the recess part includes four surfaces which are arranged to form a square shape.

9. The developer container according to claim 7, wherein the recess part includes three surfaces which are arranged to form a triangle shape.

* * * * *